US010794626B2

(12) United States Patent
Dal Savio et al.

(10) Patent No.: US 10,794,626 B2
(45) Date of Patent: Oct. 6, 2020

(54) COOLED TABLE

(71) Applicant: ATTOCUBE SYSTEMS AG, Munich (DE)

(72) Inventors: Claudio Dal Savio, Baldham (DE); Khaled Karrai, Munich (DE)

(73) Assignee: ATTOCUBE SYSTEMS AG, Munich (DE)

( * ) Notice: Subject to any disclaimer, the term of this patent is extended or adjusted under 35 U.S.C. 154(b) by 343 days.

(21) Appl. No.: 15/528,853

(22) PCT Filed: Nov. 23, 2015

(86) PCT No.: PCT/EP2015/002346
§ 371 (c)(1),
(2) Date: May 23, 2017

(87) PCT Pub. No.: WO2016/082926
PCT Pub. Date: Jun. 2, 2016

(65) Prior Publication Data

US 2017/0314843 A1 Nov. 2, 2017

(30) Foreign Application Priority Data

Nov. 24, 2014 (DE) ..... 10 2014 017 374

(51) Int. Cl.
*F25D 19/00* (2006.01)
*A47B 13/08* (2006.01)

(52) U.S. Cl.
CPC ..... *F25D 19/006* (2013.01); *A47B 13/08* (2013.01); *F25D 2201/14* (2013.01); *F25D 2400/08* (2013.01)

(58) Field of Classification Search
CPC .... F25D 19/00; F25D 19/006; F25D 2400/08; F25D 2201/14; G01N 1/42; G01M 11/04;
(Continued)

(56) References Cited

U.S. PATENT DOCUMENTS 3,942,411 A * 3/1976 Gerber ..... B23Q 1/032 409/137
4,352,643 A * 10/1982 Iijima ..... F04D 29/601 417/313

(Continued)

FOREIGN PATENT DOCUMENTS

DE 4023403 A1 * 1/1992 ..... F16C 29/00
DE 102011016552 A1 * 10/2012 ..... F25D 19/00

(Continued)

OTHER PUBLICATIONS

Jerome DeGallaix et al: "The New Croygenic Facility at LMA", Journal of Physics: conference series 363, Institute of Physics Publishing, Bristol, GB, vol. 363, No. 1, (Jun. 1, 2012), 012008, XP020224660.

*Primary Examiner* — Frantz F Jules
*Assistant Examiner* — Martha Tadesse
(74) *Attorney, Agent, or Firm* — Abelman, Frayne & Schwab

(57) ABSTRACT

The invention relates to a table having a tabletop and including a refrigerating machine, at least one section of the tabletop being coolable by means of the refrigerating machine via a thermal contact; an upper vacuum chamber, which can be evacuated, for thermally insulating the thermal contact from a surrounding area of the table, said chamber connecting an upper face of the refrigerating machine facing the tabletop and the section to be cooled, and which has at least one flexible upper chamber section; a lower vacuum chamber, which can be evacuated, which is connected to a lower face of the refrigerating machine facing away from the tabletop, and which has at least one flexible lower chamber section; and a rigid stiffening structure, which is connected to the refrigerating machine via the flexible upper chamber section and via the flexible lower chamber section.

9 Claims, 6 Drawing Sheets

(58) Field of Classification Search
CPC ... H01S 5/02236; F25B 2500/13; A47B 13/08
See application file for complete search history.

(56) References Cited

U.S. PATENT DOCUMENTS

| | | | | | |
|---|---|---|---|---|---|
| 4,394,819 | A * | 7/1983 | Averill | F02G 1/0445 | 248/636 |
| 4,930,318 | A * | 6/1990 | Brzozowski | F25D 19/006 | 250/352 |
| 5,327,733 | A * | 7/1994 | Boolchand | B01L 9/00 | 248/636 |
| 5,704,220 | A * | 1/1998 | Yamazaki | F25D 19/006 | 324/750.09 |
| 10,208,742 | B2 * | 2/2019 | Roscher | F04B 39/0027 | |
| 2007/0234751 | A1 * | 10/2007 | Nagamune | F25D 19/006 | 62/295 |
| 2009/0272127 | A1 * | 11/2009 | Radovinsky | F25D 19/006 | 62/50.7 |
| 2015/0252799 | A1 | 9/2015 | Roscher | | |
| 2017/0234766 | A1 * | 8/2017 | Haft | F25D 19/00 | 356/244 |

FOREIGN PATENT DOCUMENTS

| | | | | |
|---|---|---|---|---|
| DE | 102011016552 | A1 | 10/2012 | |
| DE | 102012019688 | A1 * | 4/2014 | F04B 37/08 |
| JP | 2006041259 | A * | 2/2006 | |

* cited by examiner

COOLED TABLE

CROSS-REFERENCE TO RELATED APPLICATIONS

This application claims the benefit under 35 U.S.C. § 371 to international application No. PCT/EP2015/002346, filed on 23 Nov. 2015, which claims priority to German application no. DE 10 2014 017374.7, filed on 24 Nov. 2014, the contents of which are incorporated by reference herein in their entireties.

FIELD OF THE INVENTION

The invention relates to a table with a tabletop, in particular an optical table for carrying out experiments in a cryogenic atmosphere.

BACKGROUND OF THE INVENTION

In many high-precision and correspondingly highly sensitive optical experiments such as for example those of Super Resolution Optical Microscopy, which is of the highest resolution and therefore extremely susceptible to disturbances, or also of quantum optics, complex measurement setups consisting of a plurality of optical components are arranged on tables. Measurement accuracy is limited by environmental influences such as vibrations, thermal effects or electromagnetic noise. Many such experiments are therefore carried out at the location of a sample to be measured under conditions of the lowest possible vibration which are also cryogenic. In the state of the art, refrigerating machines such as cryostats are arranged above or on the table.

SUMMARY OF THE INVENTION

The object of the invention is to create a table, in particular an optical table, on which many different forms of optical experiments can be carried out with the highest resolution, in a flexible and simple manner.

This object is achieved by a table with a tabletop which is borne for example by a number of table legs. The table comprises a refrigerating machine, wherein at least one section of the tabletop is in thermal contact with the refrigerating machine and can be cooled thereby. It further comprises an upper vacuum chamber that can be pumped out, for thermally insulating the thermal contact from the environment of the table. The upper vacuum chamber connects an upper side of the refrigerating machine facing the tabletop and the section to be cooled. The upper vacuum chamber comprises at least one flexible upper chamber section. The table likewise has a lower vacuum chamber that can be pumped out, which is connected to a lower side of the refrigerating machine facing away from the tabletop, with at least one flexible lower chamber section. In addition, the table has a rigid reinforcing structure which is connected to the refrigerating machine via the flexible upper chamber section and the flexible lower chamber section respectively, therefore is indirectly connected to the refrigerating machine.

The adjectives "upper" and "lower" exemplify the case of the embodiment according to the invention, preferred because it saves space on the table surface, that the refrigerating machine is arranged below the tabletop. If, according to an alternative embodiment according to the invention, the refrigerating machine is arranged above the tabletop, the adjectives "upper" and "lower" are to be correspondingly interchanged. Further equivalent embodiments are also conceivable, in which the refrigerating machine is connected to the tabletop laterally (along a spatial axis in the plane of the table surface). The adjectives "upper" and "lower" are therefore to be understood in the broadest sense as sides of the refrigerating machine "facing" and "facing away from" the tabletop respectively, wherein the sides facing and facing away denote opposite sides of the refrigerating machine with respect to a spatial axis.

A table, in particular an optical table, is used for the stable and low-vibration mechanical mounting of objects from which an optical system is constructed. These objects can be for example optical elements such as mirrors, lenses, laser sources or sample holders. "Cryogenic probe stations" are also preferably to be understood as tables.

The tabletop is characterized by significant rigidity and has a flat table surface. The tabletop is connected to a substructure with integrated damping device. The securing means for securing the objects can be an in particular regular pattern of threaded holes for receiving lugs of the objects or of magnets integrated in the tabletop for fixing magnetic feet of the objects or also adhesive. Securing means can be provided both in the tabletop and on the upper plate surface of the cryogenic plate.

The substructure can consist of one, two, three, four or more table legs. The table legs can be desiged height-adjustable in order to align the table surface horizontally, even if the table is standing on an uneven floor. The table legs can comprise a common damping device or one damping device each for vibration damping of the tabletop on the surface of which sensitive optical experiments are to be carried out. A damping device is a system for damping mechanical oscillations such as vibrations, shocks and jolts, which can usually convert kinetic energy to thermal energy. In the table surface of the tabletop, securing means can be provided for securing objects. The table legs are equipped with a damping device for damping vibrations. The table further has integrated cooling. For this, a refrigerating machine is provided for cooling a cryogenic plate under the tabletop, wherein the cryogenic plate is in thermal contact with the refrigerating machine and can be cooled thereby. Furthermore, a reinforcing structure is provided between the refrigerating machine and at least one table leg, wherein the reinforcing structure is rigidly connected to the table legs below the damping device, with the result that the damping device can damp the tabletop vis-à-vis the refrigerating machine and the areas with which the table legs stand on the floor. The refrigerating machine is supported on the reinforcing structure and is connected thereto. An opening in the tabletop is provided above the refrigerating machine. The cryogenic plate is arranged—in particular in a positively locking manner—in this hole.

According to the invention damping devices can preferably be provided between table legs and tabletop. A damping device can for example comprise a friction brake and/or resonant systems. It can for example be a mat made of elastic material such as rubber or also a spring device, a hydraulic suspension, an active piezoelectric damping control unit which, for example, piezo-electrically detects the forces acting on the table in time- and direction-resolved manner and, by means of a control unit, compensates counterforces produced likewise by piezoelectric actuators acting on the table, of the table movement forces or a pressurized air suspension or a combination thereof.

The table according to the invention further has an integrated refrigerating machine for cooling e.g. a cryogenic plate under the tabletop. The refrigerating machine can be a construction of refrigerating systems and a pump stand. The refrigerating systems consist for example of absorption refrigeration systems, adsorption refrigeration systems, diffusion absorption refrigeration machines, compression refrigeration systems, steam jet refrigeration systems, Joules-Thomson effect, Gifford-MaMahon (GM) coolers, pulse tube refrigerators, ion getter pumps, Peltier elements, magnetic cooling elements, evaporative coolers and/or cryostats. The pump stand can be a construction of moving pumps such as turbo pumps and membrane pumps as well as motionless pumps such as ion getter pumps or cryopumps. Advantageously, these components of the refrigerating machine are designed low-vibration and/or are mechanically decoupled from the tabletop. The thermal contact can for example be a structure made of materials with high thermal conductivity, which mechanically and thermally connects the refrigerating machine and the section of the tabletop to be cooled. In particular the thermal contact can be a flexible copper strand, aluminium strand or a copper wire, aluminium wire or a silver wire or silver wire mesh.

A vacuum chamber is a container which seals a volume from an environment on all sides and hermetically, with the result that, by pumping gases out of the vacuum chamber by means of a pump stand within the vacuum chamber, a lower pressure than the ambient pressure can be produced and maintained. They usually consist of steel and bear preferably standardized flanges (e.g. an ISO 100-mm flange) for connection to other components such as the table. The upper and lower vacuum chamber each comprise at least one flexible upper or, respectively, lower chamber section. These chamber sections can be for example vacuum bellows (flexible bellows) or hoses made of steel, which can be sealed at the top and bottom in each case with a connecting flange and which, at least lengthwise, can be expanded and/or contracted.

The reinforcing structure according to the invention, which is flexibly connected to the refrigerating machine via the upper chamber section and the lower chamber section respectively, is rigid and preferably also rigidly connected to rigid chamber sections of the upper vacuum chamber and lower vacuum chamber respectively. Through this rigid mechanical coupling, a force acting on one vacuum chamber also acts, via the reinforcing structure, on the other vacuum chamber. A volume of a vacuum chamber tends to be easier and efficient to keep at a slight negative pressure (e.g. approximately 10-8 mbar) vis-à-vis the ambient pressure, if the volume to be pumped out and the surface surrounding it is smaller. The reinforcing structure is therefore preferably connected to the upper and lower vacuum chambers on the environment side, not on the vacuum side. The reinforcing structure can consist of one or, for the better distribution of the force and stabilization, of several components. For example, the reinforcing structure can consist of two or three preferably length-adjustable steel beams which are connected to the upper and lower vacuum chambers respectively—e.g. angularly evenly distributed parallel to the plane of the table surface. The connection can for example be a detachable connection such as a screw connection, which allows simpler and more flexible assembly.

Embodiments of the table according to the invention comprise the features of one or more of the following designs.

According to a design according to the invention, the upper chamber section and lower chamber section are flexible at least along the same spatial axis, for example the normal to the table surface. This has the advantage, for example, that the forces acting on the upper and lower vacuum chambers, which in particular act through the evacuation, can be equalized along one spatial axis, wherein the overall construction of the table can otherwise be designed rigid and thus more stable with respect to other complementary spatial axes.

According to a further design according to the invention, the upper chamber section and lower chamber section are flexible at least along a normal to a table surface of the tabletop and otherwise rigid, with the result that a lower vacuum volume of the lower vacuum chamber and an upper vacuum volume of the upper vacuum chamber are variable. Movable vacuum parts are usually expensive and error-prone. This design has the advantage, for example, that the flexibility of the upper and lower vacuum chambers can be realized by only one flexible chamber section in each case.

According to a further design according to the invention, the reinforcing structure is rigidly connected to the upper vacuum chamber and the lower vacuum chamber respectively.

According to a further design according to the invention, the upper vacuum volume and the lower vacuum volume can be pumped out through the refrigerating machine and/or an external pump stand or various external pump stands, for example via corresponding pump lines. A pump stand can consist of several pumps arranged in series or in parallel in the flow direction of the pumped-out gas. For example, forepumps such as membrane pumps which can bear a gas flow load, although they can produce only a forevacuum pressure (e.g. approximately 10-4 mbar), can be arranged downstream of high-vacuum pumps such as turbo pumps or ion getter pumps in the flow direction. The pump lines can for example be flexible bellows tubes with flanges at the ends. This has the advantage that the table is decoupled from the vibrations of the pumps.

According to a further design according to the invention, a pressure regulation device is provided for setting an upper pressure in and/or upper gas stream from the upper vacuum chamber and a lower pressure in and/or lower gas stream from the upper vacuum chamber. In the simplest case, the pressure regulation device can be a fluid connection between the upper and lower vacuum volumes of the upper or, respectively, lower vacuum chamber. The same pressure is thereby set in the upper and lower vacuum volumes. Depending on gas load and length of the fluid connection, a minimal cross-section of the fluid connection is to be designed sufficiently extensive to allow the pressure equalization to take place sufficiently quickly in accordance with the application. The pressure regulation device can also be an electronic control system of pumps and/or controllable valves of external gas feeds of the upper and lower vacuum chambers, via which the gas stream into or from the upper and/or lower vacuum chambers can be controlled.

According to a further design according to the invention, the pressure regulation device is a fluid connection between the upper vacuum chamber and the lower vacuum chamber, with the result that the upper pressure and/or upper gas stream can be equalized with the lower pressure and lower gas stream respectively. This has the advantage, for example, that an expensive electronic control for the pressure equalization can be dispensed with.

According to a particularly simple design according to the invention, an upper surface area of the upper vacuum volume and a lower surface area of the lower vacuum volume, which are aligned parallel to the table surface, have substantially the same area, with the result that an upper force and a lower force, which can be produced along the normals to the table surface by pumping out the upper vacuum chamber and lower vacuum chamber respectively, at least partially compensate each other.

According to a further design according to the invention, the pressure regulation device is a cavity in the reinforcing structure which opens into the upper vacuum chamber and the lower vacuum chamber respectively. The reinforcing structure then functions as a fluid connection according to the invention. It can in each case be connected via vacuum flanges to counterflanges of the upper and lower vacuum chambers, with the result that the cavity fluidly connects the upper and lower vacuum volumes and is sealed vis-à-vis the environment.

According to a further design according to the invention, the pressure regulation device comprises a control unit for the tunable control of the upper pressure and/or the upper gas stream as well as of the lower pressure and lower gas stream respectively, with the result that an upper force and a lower force, which can be produced along the normals to the table surface by pumping out the upper vacuum chamber and lower vacuum chamber respectively, can at least partially compensate each other.

According to a further design according to the invention, the section that can be cooled by the refrigerating machine is at least one cryogenic plate held in the tabletop. The cryogenic plate is preferably removable and thermally decoupled from the rest of the table, for example by holders made of a material with low thermal conductivity such as for example ceramics or plastics. A sample to be measured and, for this purpose, to be cooled can be arranged on the side of the cryogenic plate opposite the refrigerating machine. For thermally insulating the sample vis-à-vis the environment of the table, which usually has ambient temperature and atmospheric pressure, a hood can be provided on a partial area of the cryogenic plate, such that an evacuable volume is defined around the sample. Vacuum-tight optical windows, manipulators, electrical feedthroughs and measuring probes can be arranged in the hood.

According to a further design according to the invention, the refrigerating machine is supported on at least one table leg of the table, on the tabletop and/or on a floor.

According to a further design according to the invention, a hood with at least one optical window, pump supply lines, preferably vacuum-tight feedthroughs for electric cables or mechanical devices such as manipulators for the objects and/or also optical shutters can additionally be provided. In particular the hood assembled on the cryogenic plate can enclose, on all sides, a cavity which is bordered at least by a partial area of the upper plate surface of the cryogenic plate, with the result that an evacuable space is formed.

The hood can in particular be a vacuum-capable chamber, on the open underside of which counterflanges corresponding to the flanges of the cryogenic plate are provided, with the result that a partial area of the upper plate surface, together with the inner surface of the hood, forms a sealed and evacuable space.

According to a further design according to the invention, a damping control system can be provided, which is operatively connected to the damping device and controls the damping device depending on detected vibrations, with the result that the tabletop and its table surface are kept free of vibrations. In particular the pressure regulation device can be integrated into a control circuit of the damping control system.

The invention further relates to a method for mechanically decoupling a tabletop of a table and a refrigerating machine which, on an upper side facing the tabletop, is connected to the tabletop via a flexible upper chamber and, on an underside facing away from the tabletop, is connected to a lower chamber. The method according to the invention is characterized in that, by means of a pressure regulation device, an upper pressure in and/or an upper gas stream from the upper vacuum chamber as well as a lower pressure in and/or a lower gas stream from the lower vacuum chamber are controlled in a tuned manner, such that an upper force and a lower force, which act along a normal to a table surface of the tabletop by pumping out the upper vacuum chamber and the lower vacuum chamber respectively, at least partially compensate each other.

The basic idea underlying the invention is to regulate the upper pressure in the upper vacuum volume and the lower pressure in the lower vacuum volume such that the upper force acting by evacuating the upper vacuum chamber sufficiently compensates the lower force acting by evacuating the lower vacuum chamber in accordance with the experiment to be carried out on the table. Along the spatial axis in which the upper and lower vacuum chambers are flexible, the upper and lower forces can bring about a movement. The upper/lower force substantially results from the quotient of upper/lower pressure and the effective surface area of the upper/lower vacuum chamber. The effective surface area relates to the plane, the normal to which is parallel to the above-named spatial axis. In the case of equal surface areas, the force equalization can be brought about by pressure equalization, for example through a fluid connection between upper and lower chambers. In this case, the upper and the lower vacuum chambers could be pumped out by the same pump stand.

A force equalization is also conceivable, in which the lower surface area is designed (e.g. ten times) greater than the upper surface area and the lower pressure (e.g. approximately 10-4 mbar) is set correspondingly lower than the upper pressure (e.g. approximately 10-5 mbar). In detail, in the case of the areas A1 and A2 at ambient pressure P, the pressure in the chambers P1 and P2 can be determined according to the relationship $(P-P1)A1=(P-P2)A2$.

This has the advantage that the upper vacuum volume remains sealed, with the result that the lowest possible vacuum can be produced with less effort, with the result that the thermal contact is thermally insulated as well as possible and the cooling capacity acting on the section of the table to be cooled is optimized. In addition a pump stand for producing a higher pressure tends to be less expensive and lower-maintenance. What has been said in respect of the setting of the upper and lower pressure is also to be applied analogously to the setting of the upper and lower gas flow in or from the upper and lower vacuum chambers respectively. This is because a pressure equalization between lower and upper vacuum chambers does not take place instantaneously. Rather, the pressure-equalizing gas flows take time. During this time, the upper and lower forces are not in equilibrium, with the result that movements such as vibrations are produced in the table, which can compromise the measurements on the tabletop which are susceptible to disturbances. Advantageously, through the compensation of the lower and upper forces, which act at least indirectly on the table, a deformation of mechanical stress on the tabletop is avoided.

BRIEF DESCRIPTION OF THE DRAWINGS

The invention and advantageous developments are illustrated in the attached figures by way of example. Identical features and features producing an identical effect are only sometimes provided with reference numbers. There are shown in.

DETAILED DESCRIPTION OF THE INVENTION

Figure 1:
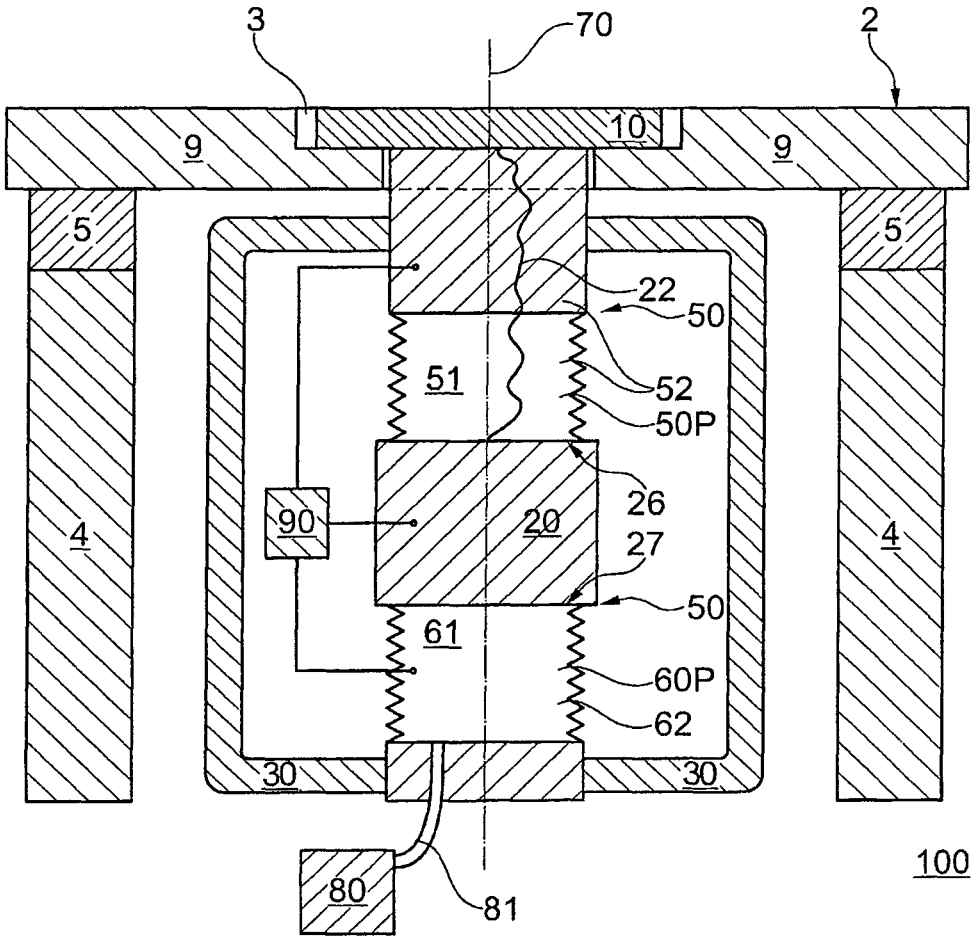
FIG. 1 a schematic sectional view of an embodiment example of the table according to the invention.

FIG. 1 shows a schematic sectional view of a table 1 according to the invention, here an optical table 1. A tabletop 9 with a tabletop surface 2 lying on top of it is borne by table legs 4. Between each table leg 4 and the tabletop 9, one damping device 5 is arranged in each case. In one (or more) openings 3 in the tabletop 9 (in each case) a cryogenic plate 10 is rigidly secured by connection elements, with the result that an upper plate surface lies flush with the table surface 2. A flange (not shown) of a flexible upper chamber section of an upper vacuum chamber 50 is in mechanical and/or fluid connection to an upper side 26 of a refrigerating machine 20.

Furthermore, the lower plate surface is in mechanical and thermal connection via a flexible element 22 made of a thermally conductive material such as copper, which can carry a flow of heat designed for efficient cooling of the cryogenic plate 10. The refrigerating machine 20 and the cryogenic plate 10 are thereby not rigidly connected mechanically and consequently are mobile against each other at least orthogonally to the table plane and vibration-insulated or vibration-damped from each other. The underside 27 of the refrigerating machine 20 is in mechanical and fluid connection to a flange (not shown) of a flexible chamber section 61 of a lower vacuum chamber 60. The upper vacuum chamber 50 and the lower vacuum chamber 60 lie on opposite sides of the refrigerating machine with respect to a normal 70 to a table surface 2 of the tabletop 9. An upper/lower vacuum volume 52/62 of the upper/lower vacuum chamber 50/60 can be evacuated by a pump stand (not shown) of the refrigerating machine 20 or via an external pump line 81 through an external pump stand (80) to an upper/lower pressure 50P/60P. A reinforcing structure 30 connects, on the side of the environment 100 and rigidly, the upper vacuum chamber 50 to the lower vacuum chamber 60, wherein the connection attaches above the upper flexible chamber section 51 and below the lower flexible chamber section 61.

Figure 2:
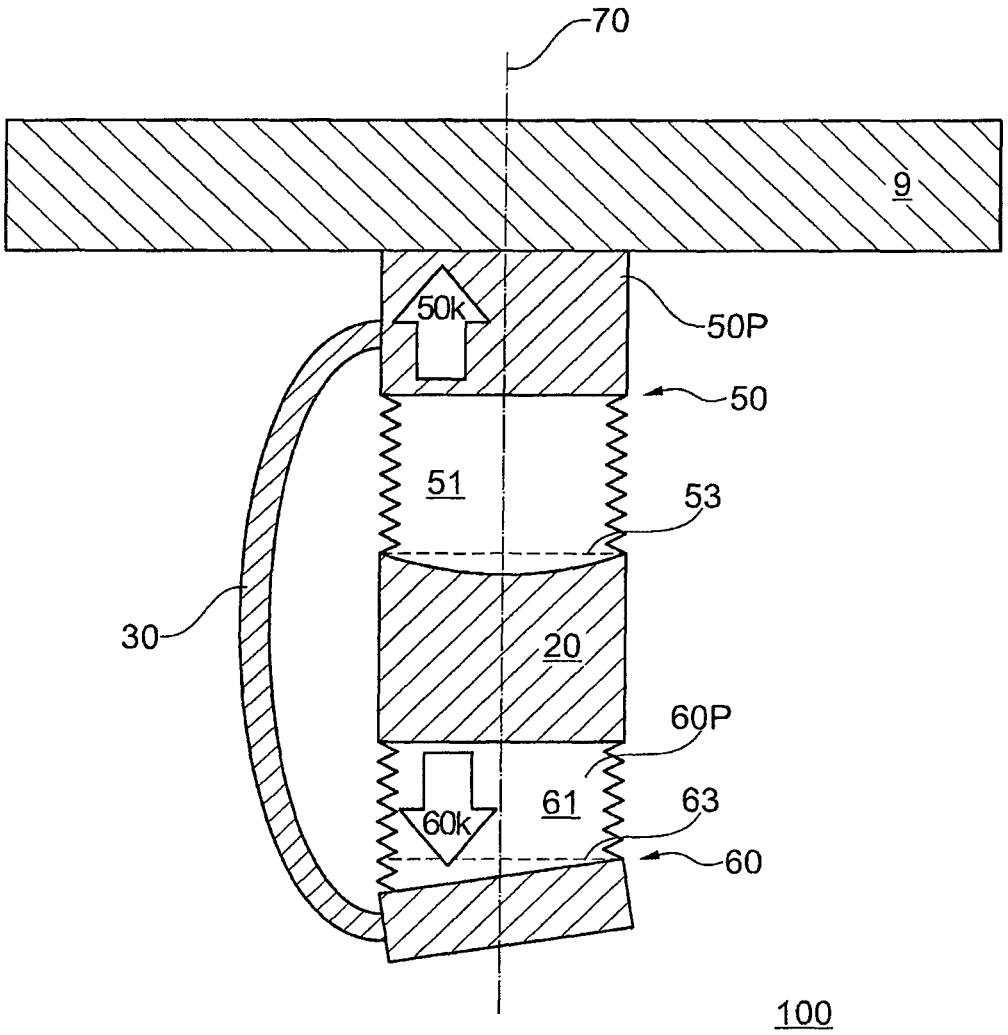
FIG. 2 a schematic sectional view of a further embodiment example of the table according to the invention.

FIG. 2 shows a sectional view of a table 1 according to the invention, as already described in FIG. 1. The flexible upper chamber section 51 and the flexible lower chamber section 61 can be contracted and expanded along the normal 70. Through the upper/lower pressure 50P/60P, which acts on the upper/lower surface area 53/63 orthogonal to the normal 70, an upper force 50K and a lower force 60K are formed, which act on the refrigerating machine 20 in opposite directions along the normal 70. If the lower force 60K is equal to the upper force 50K, the refrigerating machine 20 is not moved against the tabletop 9. This thus-suppressed movement could for example induce vibratory disturbances for the experiments taking place on the tabletop 9 (experimental set-up not shown). The upper force 50K is equal to the lower force 60K when the quotient of the difference between the ambient pressure P and the lower pressure 60P P2 and the difference between the ambient pressure P and the upper pressure 50P P1 is equal to the quotient of upper surface area 53 A1 and lower surface area 63 A2, A1/A2=(P−P2)/(P−P1).

Figure 3:
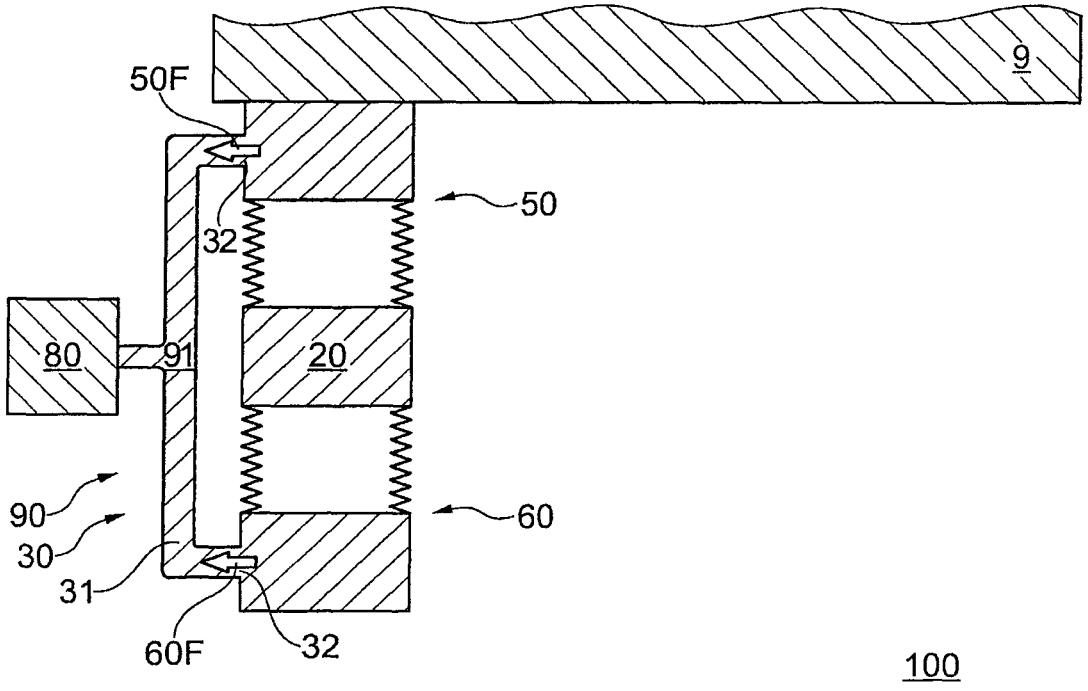
FIG. 3 a schematic sectional view of a further embodiment example of the table according to the invention.

FIG. 3 shows a sectional view of a table 1 according to the invention. The reinforcing structure 30 functions as a pressure regulation device 90, in order to equalize the upper pressure 50P and the lower pressure 60P. A cavity 31 of the reinforcing structure has outlets 32 into the upper vacuum chamber 50 and the lower vacuum chamber 60 respectively. This cavity 31 functions as fluid connection 91 for an upper gas flow 50F from the upper vacuum chamber 50 and a lower gas flow 60F from the lower vacuum chamber 60 to an external pump stand 80 or alternatively to a pump stand (not shown) of the refrigerating machine 20. It is also conceivable to design the pressure regulation device 90 as a component separate from the reinforcing device 30, for example as a flexible bellows tube.

Figure 4:
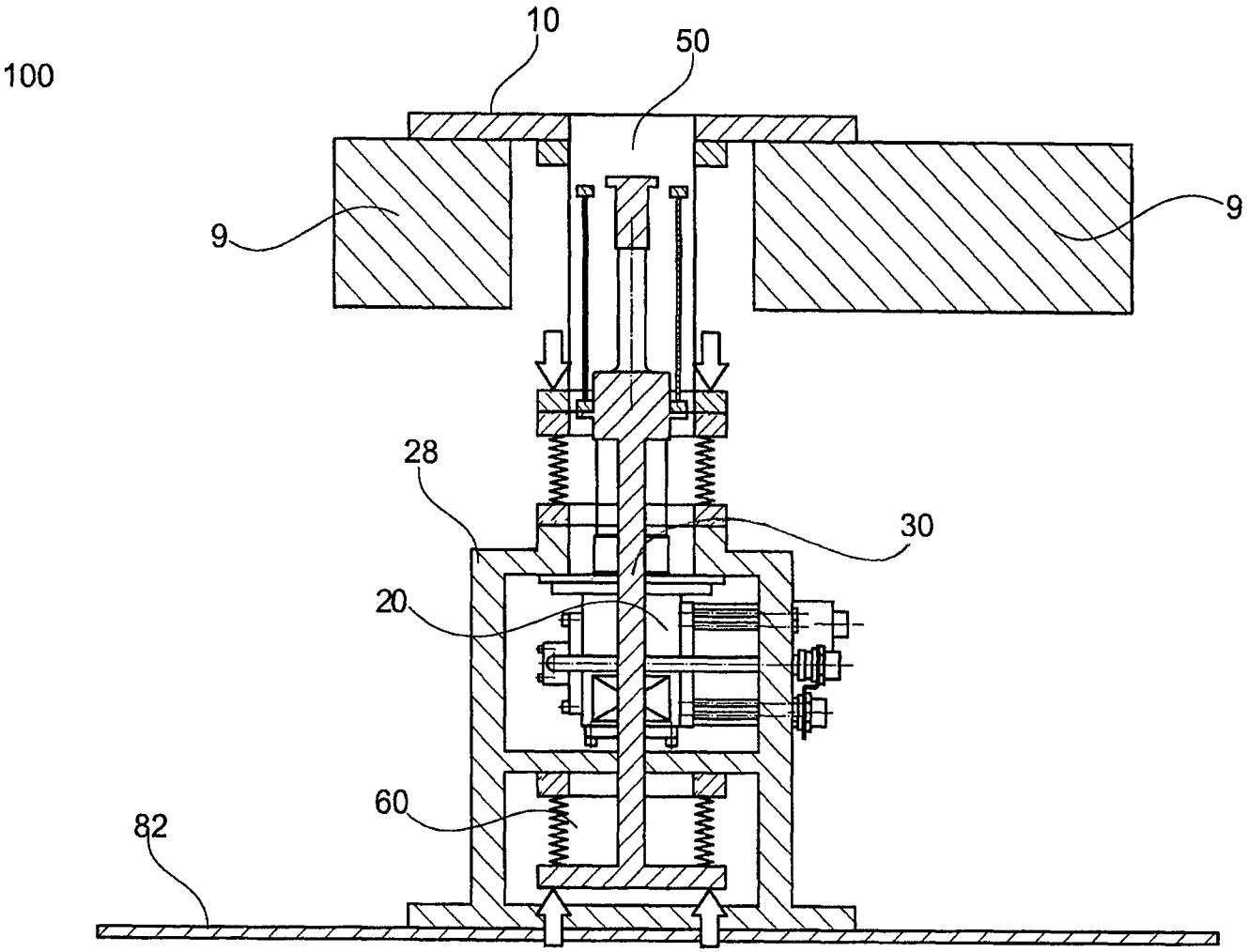
FIG. 4 a schematic sectional view of a further embodiment example of the table according to the invention.

FIG. 4 shows a sectional view of a table 1 according to the invention. A cryogenic plate 10, to which the upper vacuum chamber 50 is flanged from below, is arranged on an opening 3 in the tabletop 9. The flexible upper chamber section 51 is flanged to the refrigerating machine 20 from above, for example by means of vacuum-technical of the upper vacuum chamber 50. In this embodiment the refrigerating machine 20 is supported in a rigid frame 28 which stands on the floor 82. From below, a flexible lower chamber section 61 of a lower vacuum chamber 60 is flanged to the refrigerating machine 20 or to the frame 28 rigidly connected thereto. The flexible upper chamber section 51 and the flexible lower chamber section 61 can for example be designed as a flexible bellows with annular connection flanges welded onto the ends in each case. The connection flanges can for example have an outer diameter of 6" OD (approx. 152 mm) as well as an inner diameter of the free opening of 5" ID (127 mm), 4" ID (101.6 mm) or 3.5" ID (89 mm). In the case of a typical setting of the upper/lower pressure 50P/60P in the upper/lower vacuum chamber 50/60, based on the atmospheric pressure (usually 1 bar) of the environment 100, an upper force 50K and a lower force 60K act equally in opposite directions, with the result that they compensate each other and compress the lower and upper flexible bellows. For an upper/lower surface area 53/63, which corresponds to the free inner diameter of the connection flange of the bellows of 101 (127) mm, then the upper/lower force 50K/60K is 80 (127) Newtons.

Figure 5:
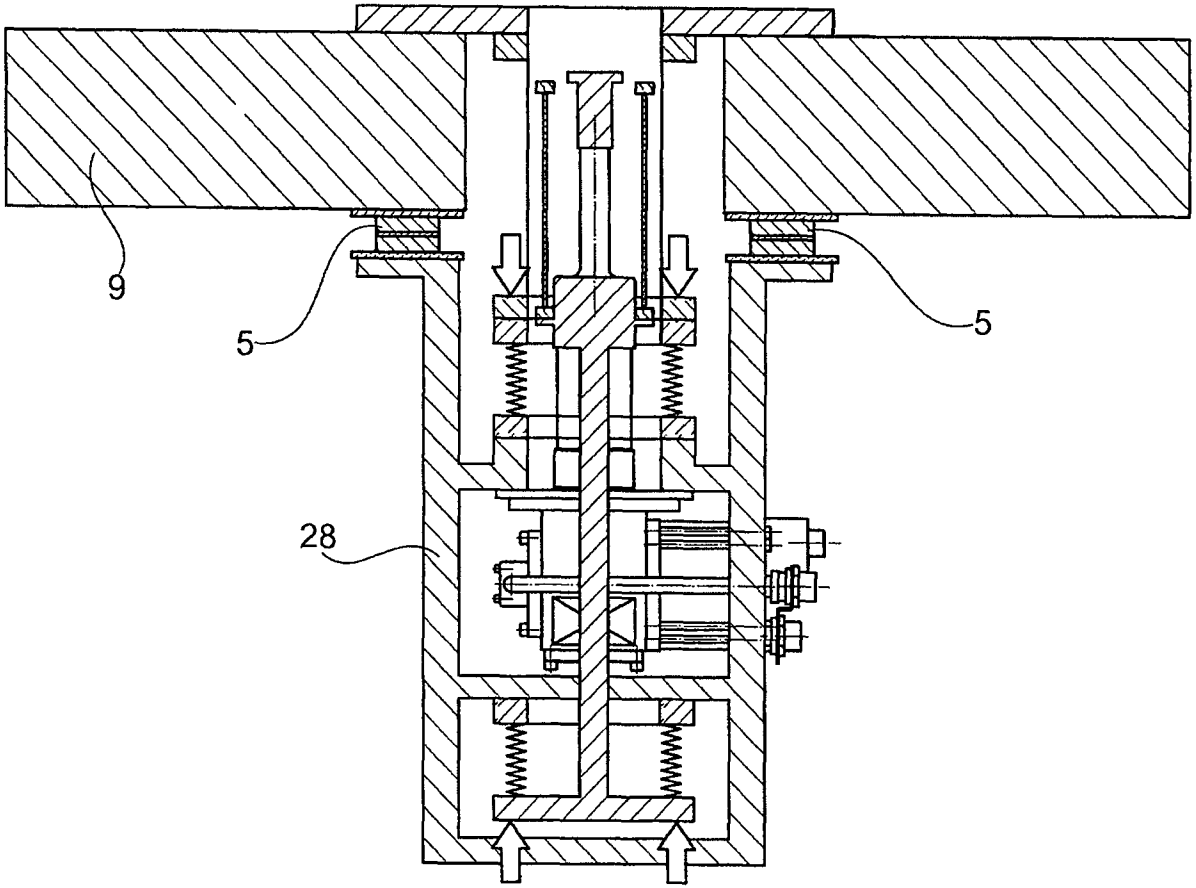
FIG. 5 a schematic sectional view of a further embodiment example of the table according to the invention.

FIG. 5 shows a sectional view of a table 1 according to the invention. In a modification of the embodiment represented in FIG. 4, the frame 28 is connected to the tabletop 9 via a number of damping devices 5.

Figure 6:
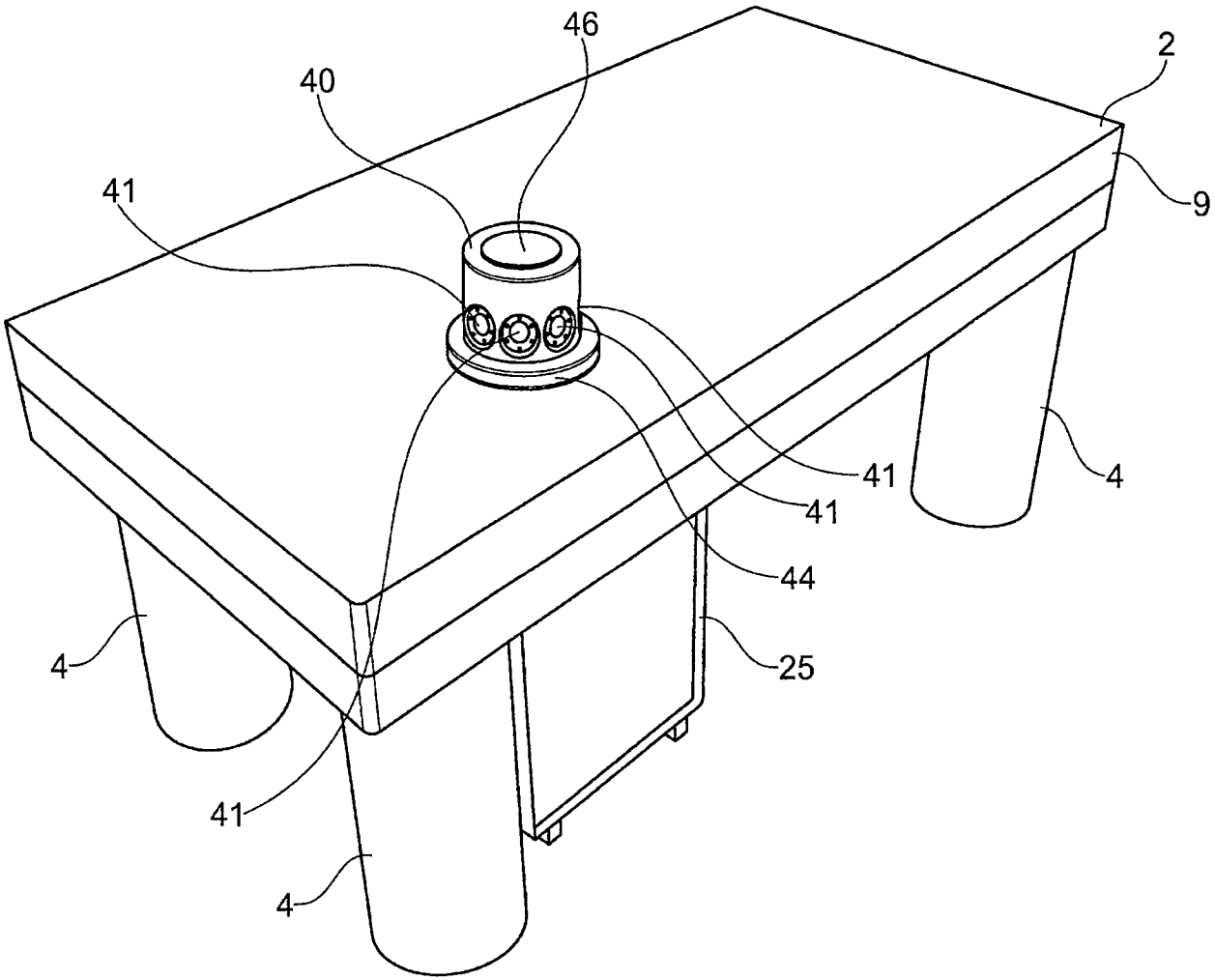
FIG. 6 a perspective view of a table according to the invention with an assembled hood.

FIG. 6 shows a perspective view of a table 1 according to the invention with table legs 4, a tabletop 9 as well as an assembled hood 40, for receiving for example a sample to be examined (not shown). The refrigerating machine is arranged in a housing 25 under the table. In the upper region the hood 40 bears a viewing window 46 as well as further viewing windows 41 in the lateral region for inspection of its interior by an experimenter. Together with the tabletop 9 bordering it, the hood 40 defines a volume that can be evacuated, in particular via an external pump stand 80. The hood 40 is secured to the surface 2 of the table via a flange 44. Inside the hood 40 a sample can be examined via the windows 41, 46, wherein the sample can be kept in a cryogenic atmosphere.

A person skilled in the art is also prompted by the invention disclosed here to combine features which are described in the context of different embodiments according to the invention, where technically possible.

LIST OF REFERENCE NUMBERS

1 Table
2 Table surface
3 Opening
4 Table legs
5 Damping device
7 Securing means
9 Tabletop
10 Cryogenic plate
20 Refrigerating machine
22 Thermal contact
26 Upper side
27 Underside
28 Frame
30 Reinforcing structure
31 Cavity
32 Outlet
40 Hood
41 Window
42 Cavity
44 Ambient temperature counterflange
45 Cryogenic counterflange
46 Viewing window
50 Upper vacuum chamber
50F Upper gas stream
50K Upper force
50P Upper pressure
51 Flexible upper chamber section
52 Upper vacuum volume
53 Upper surface area
60 Lower vacuum chamber
60F Lower gas stream
60K Lower force
60P Lower pressure
61 Flexible lower chamber section
62 Lower vacuum volume
63 Lower surface area
70 Spatial axis, normal
80 External pump stand
81 External pump line
82 Floor
90 Pressure regulation device
91 Fluid connection
100 Environment

What is claimed is:

1. A table with a tabletop, comprising:

a refrigerating machine, wherein at least one section of the tabletop is selectively cooled with the refrigerating machine via a thermal contact;

a first vacuum chamber that is selectively pumped out for thermally insulating the thermal contact from an environment of the table, and a second vacuum chamber that is selectively pumped out, wherein the first and second vacuum chambers lie on opposite sides of the refrigerating machine with respect to a normal axis to a table surface of the tabletop.

2. The table according to claim 1, wherein the at least one section that is selectively cooled by the refrigerating machine is a cryogenic plate held in the tabletop.

3. The table according to claim 1, wherein the first vacuum chamber and second vacuum chamber are formed from a flexible material at least along the normal axis to the table.

4. The table according to claim 1, wherein the first vacuum chamber and second vacuum chamber are selectively pumped out through an external pump.

5. A table with a tabletop, comprising:

a refrigerating machine, wherein at least one section of the tabletop is selectively cooled with the refrigerating machine via a thermal contact;

a first vacuum chamber which is selectively pumped out to thermally insulate the thermal contact from an environment of the table, and which connects to an upper side of the refrigerating machine facing the tabletop and the section to be cooled; and a second vacuum chamber that is selectively pumped out.

6. The table according to claim 5, wherein the at least one section which is selectively cooled by the refrigerating machine is a cryogenic plate held in the tabletop.

7. The table according to claim 5, wherein the first vacuum chamber and second vacuum chamber are selectively pumped out through an external pump.

8. The table according to claim 1, wherein the first vacuum chamber and second vacuum chamber are selectively pumped out through the refrigerating machine.

9. The table according to claim 5, wherein the first vacuum chamber and second vacuum chamber are selectively pumped out through the refrigerating machine.

* * * * *